US005853340A

United States Patent [19]

Willis

[11] Patent Number: 5,853,340

[45] Date of Patent: Dec. 29, 1998

[54] SHUTTLECOCKS

[76] Inventor: Gordon Willis, 16 Folly Avenue, St. Albans, Hertfordshire AL3 5QD, United Kingdom

[21] Appl. No.: 930,287

[22] PCT Filed: Mar. 26, 1996

[86] PCT No.: PCT/GB96/00711

§ 371 Date: Oct. 1, 1997

§ 102(e) Date: Oct. 1, 1997

[87] PCT Pub. No.: WO96/31260

PCT Pub. Date: Oct. 10, 1996

[30] Foreign Application Priority Data

Apr. 3, 1995 [GB] United Kingdom ..... 9506833

[51] Int. Cl.[6] ..... A63B 67/18

[52] U.S. Cl. ..... 473/579

[58] Field of Search ..... 473/579, 580, 473/217

[56] References Cited

U.S. PATENT DOCUMENTS

| | | | |
|---|---|---|---|
| 2,538,348 | 1/1951 | Amphlett . | |
| 2,626,806 | 1/1953 | Carlton | 473/579 |
| 2,830,817 | 4/1958 | Schoberl . | |
| 2,860,879 | 11/1958 | Carlton | 473/579 |
| 3,831,943 | 8/1974 | Popplewell | 473/579 |

FOREIGN PATENT DOCUMENTS

| | | | |
|---|---|---|---|
| 1164895 | 3/1964 | Germany | 473/217 |
| 145161 | 5/1954 | Sweden | 473/217 |
| 184161 | 6/1963 | Sweden | 473/217 |
| 949110 | 2/1964 | United Kingdom . | |
| 1542497 | 3/1979 | United Kingdom . | |
| 2263412 | 7/1993 | United Kingdom . | |
| 2283687 | 5/1995 | United Kingdom . | |

*Primary Examiner*—John A. Ricci

*Attorney, Agent, or Firm*—Tilton, Fallon, Lungmus & Chestnut

[57] ABSTRACT

A shuttlecock comprises a nose and a frusto-conical skirt fixed thereto. The skirt is formed of an inner layer and an outer layer of plastics sheet material generally lying against one another. The outer layer is formed with a plurality of spaced elongate channels which are open towards the inner layer and the inner layer is formed with a plurality of spaced elongate channels corresponding to and aligned with those of the outer layer and opening towards the outer layer such that the channels of the inner and outer layers of the skirt cooperate to form hollow stiffening columns. Elongate stiffening members are located within the hollow stiffening columns and are bonded to both layers of the skirt.

9 Claims, 3 Drawing Sheets

SHUTTLECOCKS

The invention relates to a badminton shuttlecock.

Serious club badminton players use only feather shuttles and all senior tournaments stipulate their use. This is because no design of artificial feather shuttlecock performs in a sufficiently similar way to a feather shuttlecock. All present designs fall down in some or all of the following ways: the rigidity of the skirt; the speed of rotation through the air at different velocities; the initial speed off the racket face; the sound and/or feel of the shuttlecock when hit; the tumble characteristics when a soft 'net' shot is played; the appearance of the shuttlecock.

This is not to say that feather shuttlecocks are seen as the ideal. Natural feather shuttlecocks can never be consistent and have to be selected at manufacture and often undergo further selection by players. They can be more affected by the atmospheric conditions than synthetic materials. They seldom last a whole game, and often change their flight characteristics in the process of a rally. Because the feathers can be disturbed players can indulge in "gamesmanship" by tampering with them. Since the flight performance is so inconsistent and assessment is subjective, players are known to reject shuttlecocks as a further form of gamesmanship.

Most innovations in synthetic designs are concerned with mimicking the natural rotation of the feather shuttlecock. They do this with varying degrees of success but normally at the expense of the structural integrity of the skirt. Hence, when they are hit hard, the skirt streamlines and travels faster than a feather shuttlecock. This biases the game too far towards the hard hitting players. The lack of rigidity of existing synthetic designs also causes the skirt to collapse on impact with the racket, such that the nose often leaves the racket face pointing downwards, rather than upwards as with a feather shuttlecock. The rigidity of a feather skirt gives an immediate bounce response and hence a fast tumble speed.

There has been little apparent attempt to emulate the acoustic qualities of feathers. This is more important than generally realised or admitted to by players. The solid impact noise of a feather shuttlecock is rewarding to players and gives important feedback as to where it has been struck on the racket and the technique of the hitting action. This is partly due to the substance of the feather and partly due to the radial displacement of each feather, and the rigidity given by the feather stem.

Most synthetic shuttlecock designs use a one piece injection moulded skirt. The hollow construction of a natural feather stem gives a very high strength to weight ratio, which cannot be achieved with a solid section as in the injection moulded designs which exist. Two recorded designs attempt to overcome this problem with the use of two components to the skirt. Patent application GB 2263412A shows a skeletal rib structure supporting a film skirt. The main purpose of this is to support helical fins to increase the spin speed of the shuttlecock. There is no enhanced integrity with this type of construction and the rib and/or film thickness would have to be minimised (in order to compare with the weight of a feather skirt) to such a degree that the skirt would collapse on impact and at high speeds. Patent GB 1542497 shows a shuttlecock having a skirt formed by a double skin pleated film structure. However, the regular pleated structure would not induce any flight spin which is essential to the flight characteristics of a shuttlecock and the general performance would be unacceptable. When in contact with the strings of a racket, the rigid peaks of this structure would give a very different response to a feather shuttlecock. Very thin material would be necessary to keep the weight within specification which would not afford a practicable production process. The same is true of UK patent application GB 2283687A which shows a shuttlecock having a skirt formed by a corrugated sheet and a reinforcing band.

Even if the nose of the shuttlecock is struck first, the skirt is tumbled onto the racket face and is the cause of the difference in feel between different shuttlecocks described by players. The subtlety of the contact and response produced by a natural feather skirt has not been dealt with and/or understood by designers of synthetic shuttlecocks. The feather stems and annular bindings of a natural feather shuttlecock, make a very light rigid cone which deforms only slightly in impact and does not collapse in flight, while the overlapping feathers protrude to provide spin in flight and a soft initial contact on the racket face followed by a slight bounce response as the shuttlecock leaves the racket, noticeable on gentle 'touch' shots.

The invention seeks to resolve the problems of the prior art and to simplify manufacture and keep costs to a minimum.

According to the invention, there is provided a shuttlecock comprising a nose and a frusto-conical skirt fixed thereto, the skirt being formed of an inner layer and an outer layer generally lying against one another; wherein one of the layers is formed with a plurality of spaced elongate channels which are open towards the other layer and form hollow stiffening columns with the inner layer; and wherein elongate stiffening members are located within the hollow stiffening columns.

According to a further aspect of the invention, there is provided a shuttlecock comprising a nose and a frusto-conical skirt fixed thereto, wherein the nose is formed with an axial bore therethrough for the passage of air.

BRIEF DESCRIPTION OF THE DRAWINGS

Embodiments of the invention are described below with reference to the accompanying drawings in which.

DETAILED DESCRIPTION OF THE INVENTION

Figure 1:
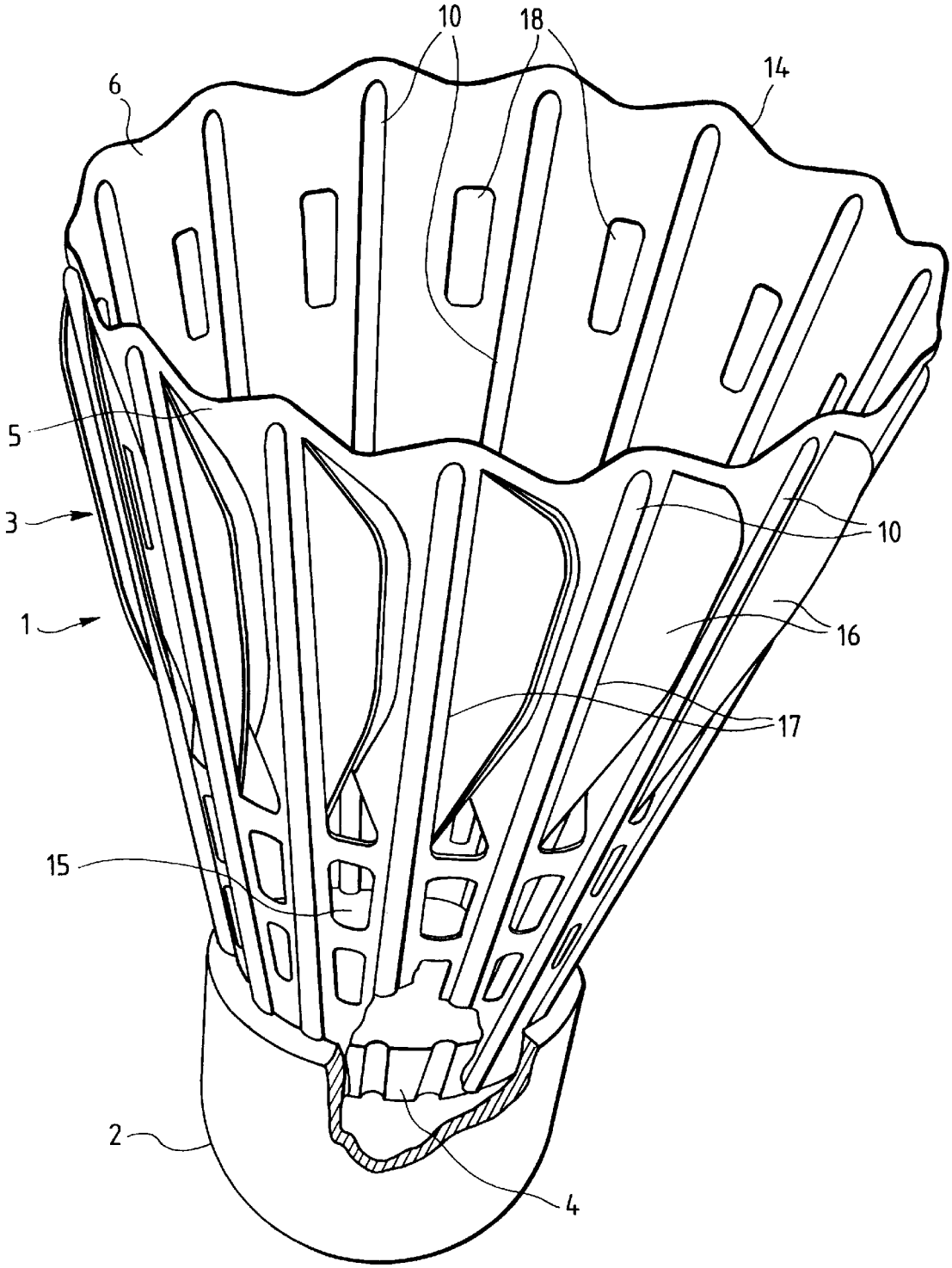
FIG. 1 is a perspective view of a shuttlecock partly broken away.

FIG. 1 shows a shuttlecock 1 comprising a traditional rounded nose 2 and a frusto-conical skirt 3 which is fitted to the nose. As shown, the nose is hollow and the skirt is fitted by means of a fitting disc 4. In alternative embodiments (not shown) the nose may be solid with a recess for receiving the lower end of the skirt 3.

The skirt is formed of an inner layer 5 and an outer layer 6 of plastics sheet material which are formed in matching part cone shapes. As seen best in FIG. 2, the outer layer 6 is formed with a plurality of spaced elongate channels 8 which are open towards the inner layer 5 and the inner layer 5 is similarly formed with a plurality of spaced elongate channels 9 which correspond to and are aligned with the channels 8 of the outer layer, and which open towards the outer layer. The channels 8,9 co-operate to form hollow stiffening columns 10. The inner and outer layers 5,6 are bonded to one another, such as by glueing. The inner and outer layers are preferably bonded together over all their mating surfaces. In an alternative embodiment (not shown), only one of the layers is formed with elongate channels. These channels nevertheless co-operate with the other layer to form hollow stiffening columns.

Elongate stiffening members 11 are located within the hollow columns 10 and are bonded, such as by glueing, to both layers 5, 6 of the skirt 3. As shown in the enlarged portion of FIG. 2, the stiffening members are hollow tubes. Alternatively, solid stiffening members formed, for example, by foamed plastics may be provided. The stiffening columns 10 emulate the quill portions of a feather shuttlecock and can have parallel or tapered sides. The stiffening members 10 help prevent delamination of the skirt and greatly increase the structural rigidity and integrity of the skirt.

As shown in FIG. 1, the hollow columns 10 extend from the nose substantially to the free edge 14 of the skirt. In this case the stiffening members 11 will be of a length similar to or slightly less than that of the stiffening columns 10.

Figure 2:
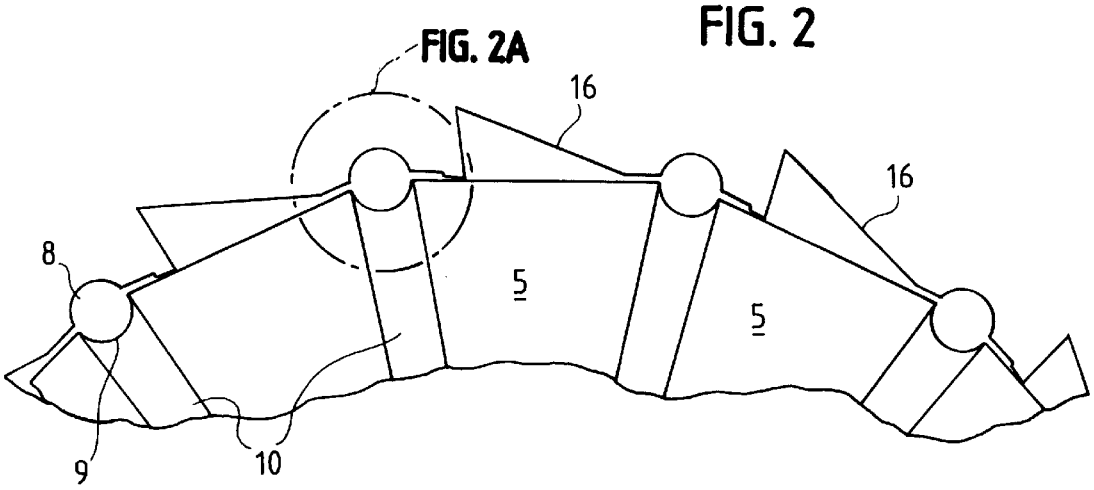
FIG. 2 is a partial sectional view through the skirt of a shuttlecock in a plane transverse to the axis of the shuttlecock.
Figure 2A:
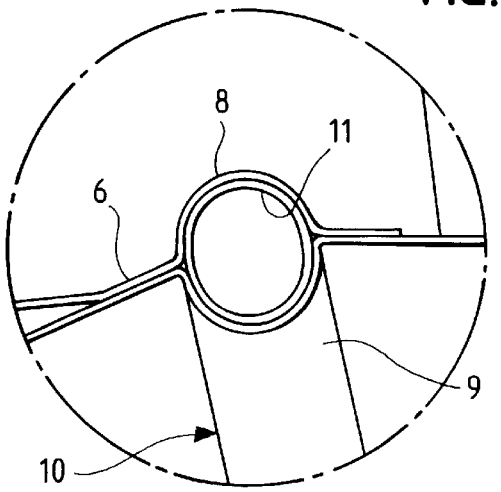
FIG. 2A is an enlarged view of the indicated portion of the shuttlecock of FIG. 2.
Figure 3:
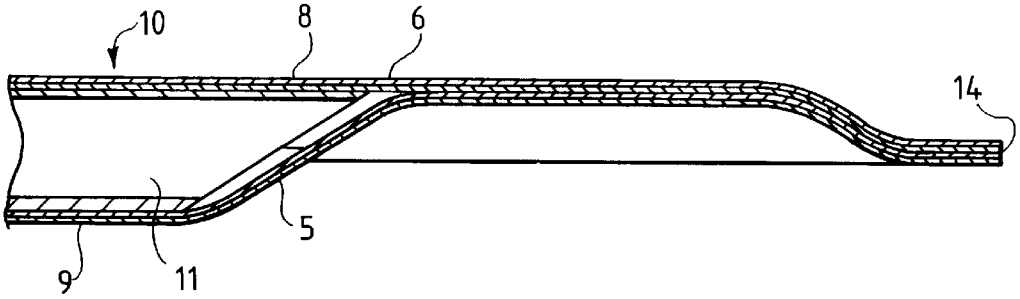
FIG. 3 is a partial sectional view through the skirt of a shuttlecock in an axial plane and on an enlarged scale.

In a variation shown in FIG. 2, the stiffening columns 10 and the stiffening members 11 extend from the nose to a position spaced from the free edge 14 of the skirt and in the outer part of the skirt the channels 9 of the inner layer 5 are inverted so that they nest in the corresponding channels 8 of the outer layer 6. In an alternative (not shown) it is the channels 8 of the outer layer 6 which are inverted.

Because the columns 10 are of similar width to the quill portions of the feathers used in traditional shuttlecocks, they allow ample space in the facets between them on the skirt for the formation of flight modification devices. Typically the facet space between each column 10 at its end remote from the nose is 3–5 or more times the width of the column at that point. Flight modification devices include through-holes 15 formed between the columns 10 which simulate the openings found in feather shuttlecocks at the same position. A hinged flap 16 is cut in the outer layer 6 of the skirt 3 between each column 10. The flaps 16 are hinged along an edge 17 and, when relaxed, protrude slightly from the cone of the skirt to simulate the feathers of a feather shuttlecock and cause the shuttlecock to spin in flight. Air spaces behind the flaps are closed when the flap tends to be pushed flat when travelling at high speed. Further openings 18 are provided in the inner layer 5 behind the flaps 16.

If necessary, further strengthening ribs (not shown) may be provided in a circumferential direction in the facets between the columns 10.

In order to emulate a feather shuttlecock, the inner and/or outer layers 5,6 may be formed with slits (not shown) between the columns 10 extending a short distance from the free edge 14 of the skirt towards the nose.

In order to further emulate a feather shuttlecock, the surfaces of the skirt may be at least partially covered in granular or thread material.

In order to increase strength and/or to effect acoustic dampening, one or both of the layers of the skirt may be formed as a laminate of two or more materials such as plastic film and fabric. Such lamination increases the life of the shuttlecock and lessens the occurrence of tearing and stress cracking which might occur if single layer materials are used.

In feather shuttlecocks, sixteen feathers are used. The shuttlecock shown herein has fourteen columns and fourteen facets therebetween but this number could be reduced or increased as required. By providing less than sixteen columns the size of the facets between the columns available for the formation of flight modification devices is increased.

Figure 4:
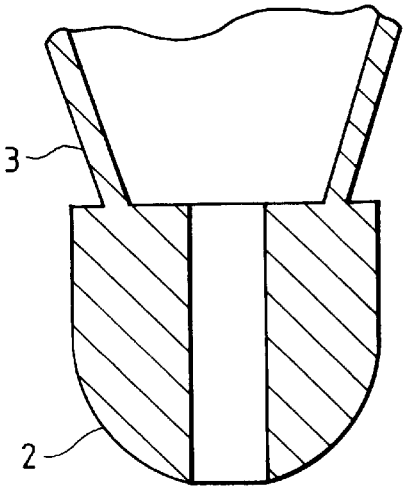
FIG. 4 is an axial cross-section through a modified nose and part of a skirt of a shuttlecock.
Figure 5:
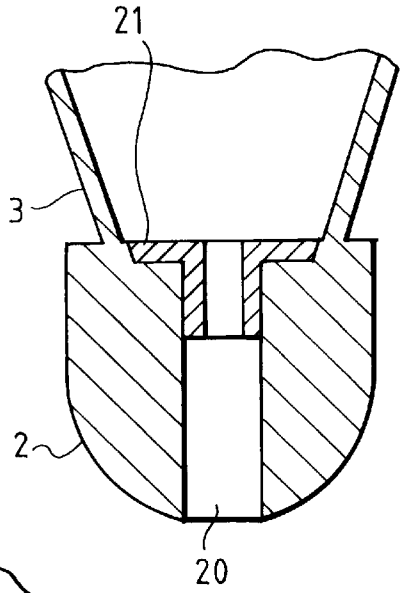
FIG. 5 is an axial cross-section through a further modified nose and part of a skirt of a shuttlecock.
Figure 7:
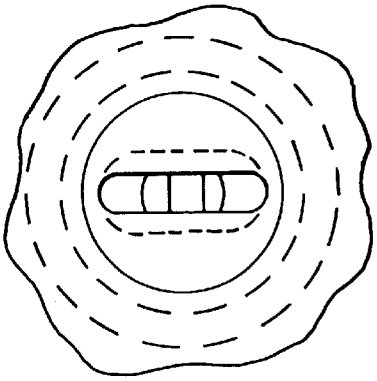
FIG. 7 is a plan view of the nose and part of the skirt of the shuttlecock shown in FIG. 6.
Figure 6:
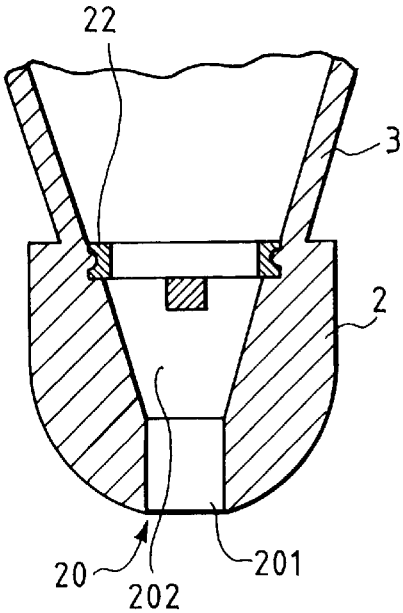
FIG. 6 is an axial cross-section through a yet further modified nose and part of a skirt of a shuttlecock.

FIGS. 4–6 show modified noses for shuttlecocks. In each case the nose is formed with an axial bore 20 therethrough for the passage of air. In FIG. 4, an interchangeable insert 21 is fitted into the bore to control the passage of air therethrough. In FIGS. 6 and 7 the bore has a cylindrical portion 201 and a frusto-conical portion 202. An adjustable rotary shutter 22 is located in the bore to control the passage of air therethrough.

The bore 20 and insert or shutter if provided permit the controlled flow of air through the nose of the shuttlecock and can thus reduce the weight of the shuttlecock and modify its flight characteristics.

I claim:

1. A shuttlecock (1) comprising a nose (2) and a frusto-conical skirt (3) fixed thereto, said skirt being formed of an inner layer (5) and an outer layer (6) generally lying against one another; wherein one of said layers (6) is formed with a plurality of spaced elongate channels (8) which are open towards the other of said layers (5) and form hollow stiffening columns (10) with the other of said layers; and wherein elongate stiffening members (11) are located within said hollow stiffening columns.

2. A shuttlecock as claimed in claim 1, wherein said other layer (5) of said skirt (3) is formed with a plurality of spaced elongate channels (9) corresponding to and aligned with said spaced elongate channels (8) of said one layer (6) and opening towards said one layer such that said elongate channels (8,9) of said inner and outer layers of said skirt cooperate to form said inner and outer layers of said hollow stiffening columns (10).

3. A shuttlecock as claimed in claim 1 or claim 2, wherein a hinged flap (16) is cut in said outer layer (6) of said skirt (3) between each pair of said stiffening columns (10).

4. A shuttlecock as claimed in claim 1 or 2, wherein through-holes (15) are formed in said skirt between said stiffening columns (10).

5. A shuttlecock as claimed in claim 1 or 2, wherein said inner and outer layers (5, 6) of said skirt (3) are bonded to one another over all their mating surfaces.

6. A shuttlecock as claimed in claim 1 or 2, wherein said elongate stiffening members (11) are bonded to both said layers (5,6) of said skirt (3).

7. A shuttlecock as claimed in claim 1 or 2, wherein said hollow stiffening columns (10) extend from said nose (2) substantially to the free edge (14) of said skirt (3).

8. A shuttlecock as claimed in claim 1 or 2, wherein said hollow stiffening columns (10) extend from said nose (2) to a position spaced from the free edge (14) of said skirt and wherein said channels (9) in said one of the layers in that part of said skirt beyond the ends of said stiffening columns are inverted so that they nest in the corresponding said channels (8) of said other layer.

9. A shuttlecock as claimed in claim 1 or 2, wherein one or both of said layers (5,6) of said skirt (3) is formed as a laminate of two or more materials.

* * * * *